US007506644B2

(12) United States Patent
Park

(10) Patent No.: US 7,506,644 B2
(45) Date of Patent: Mar. 24, 2009

(54) GRINDING WHEEL

(76) Inventor: Rin-Soon Park, 150-3, Wonjong-dong, Ojeong-gu, Yongsang APT. 1-401, Bucheon-si (KR) 421-200

( * ) Notice: Subject to any disclaimer, the term of this patent is extended or adjusted under 35 U.S.C. 154(b) by 0 days.

(21) Appl. No.: 11/575,196

(22) PCT Filed: Sep. 13, 2005

(86) PCT No.: PCT/KR2005/003012

§ 371 (c)(1),
(2), (4) Date: Mar. 13, 2007

(87) PCT Pub. No.: WO2006/031044

PCT Pub. Date: Mar. 23, 2006

(65) Prior Publication Data

US 2007/0254568 A1 Nov. 1, 2007

(30) Foreign Application Priority Data

Sep. 15, 2004 (KR) ..... 10-2004-0073792

(51) Int. Cl.
*B28D 1/12* (2006.01)

(52) U.S. Cl. ..... 125/22

(58) Field of Classification Search ..... 125/22; 451/543, 548

See application file for complete search history.

(56) References Cited

U.S. PATENT DOCUMENTS 1,502,697 A * 7/1924 Tone ..... 451/543
1,589,855 A * 6/1926 Hyde ..... 451/548
1,663,310 A * 3/1928 MacAulay ..... 451/548
1,954,560 A * 4/1934 Cunningham ..... 451/541
2,177,549 A * 10/1939 Kirchner ..... 451/543
2,282,912 A * 5/1942 Van Der Pyl ..... 51/293
5,076,023 A * 12/1991 Saguchi ..... 451/540
5,243,790 A * 9/1993 Gagne ..... 451/528
5,247,765 A 9/1993 Quintana
5,567,503 A * 10/1996 Sexton et al. ..... 428/143
6,129,077 A * 10/2000 Parini ..... 125/15
6,196,911 B1 * 3/2001 Preston et al. ..... 451/548

FOREIGN PATENT DOCUMENTS

JP 05069337 A * 3/1993
JP 11-151675 6/1999
KR 20-0284945 7/2002

* cited by examiner

*Primary Examiner*—Maurina Rachuba
(74) *Attorney, Agent, or Firm*—IPLA P.A.; James E. Bame

(57) ABSTRACT

A grinding wheel has a disc having a connection hole formed at a center thereof, to which a rotation axis of a grinder is connected, and a plurality of abrasive segments detachably connected to a surface of the disc. A plurality of fixing recesses are radially formed on the surface of the disc at an interval and fixing protrusions having a shape corresponding to the fixing recess are formed on bottom surfaces of the abrasive segments, so that the abrasive segments are connected to the disc by inserting the fixing protrusions into the fixing recesses. According to the grinding wheel, when the abrasive segment is worn away or inferior as it is used for a long time, it has only to replace the corresponding abrasive segment only. Accordingly, an economical efficiency is high.

2 Claims, 3 Drawing Sheets

[Fig. 1]
Prior Art
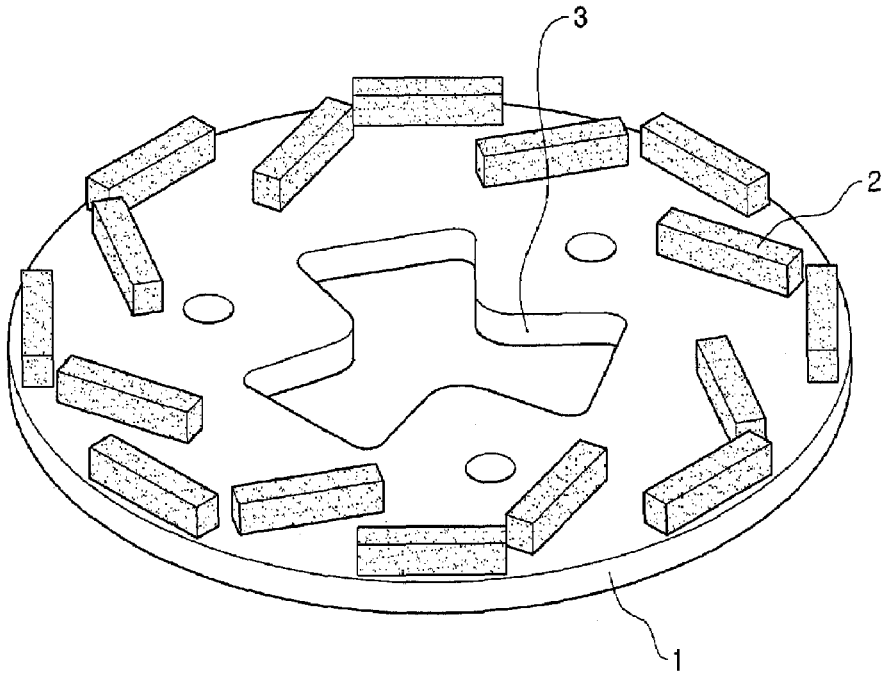
[Fig. 2]
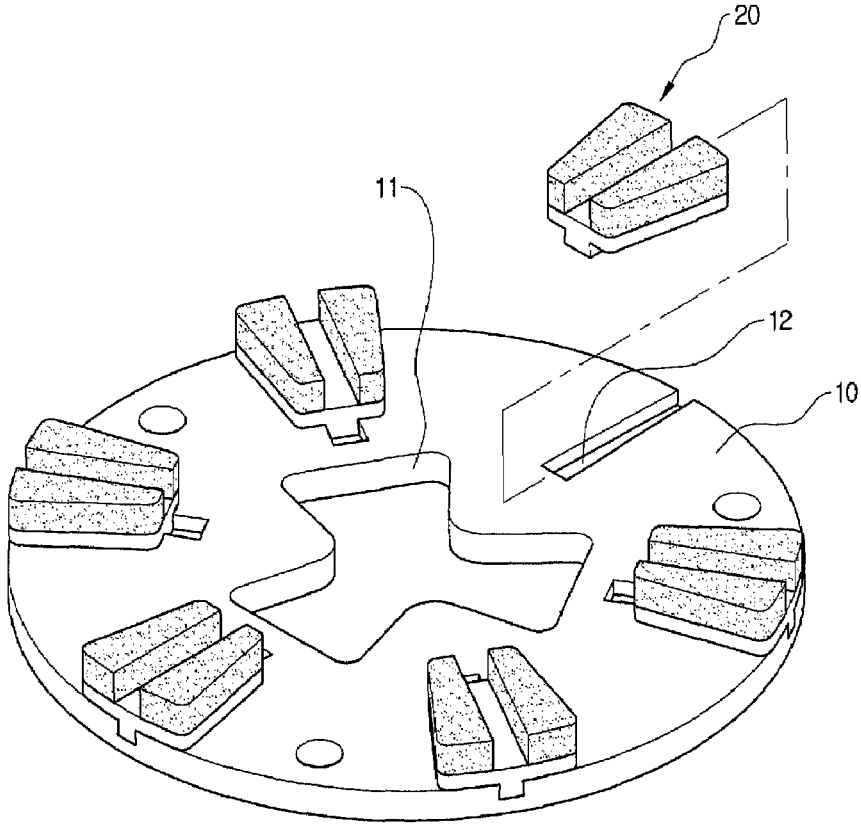

[Fig. 3]
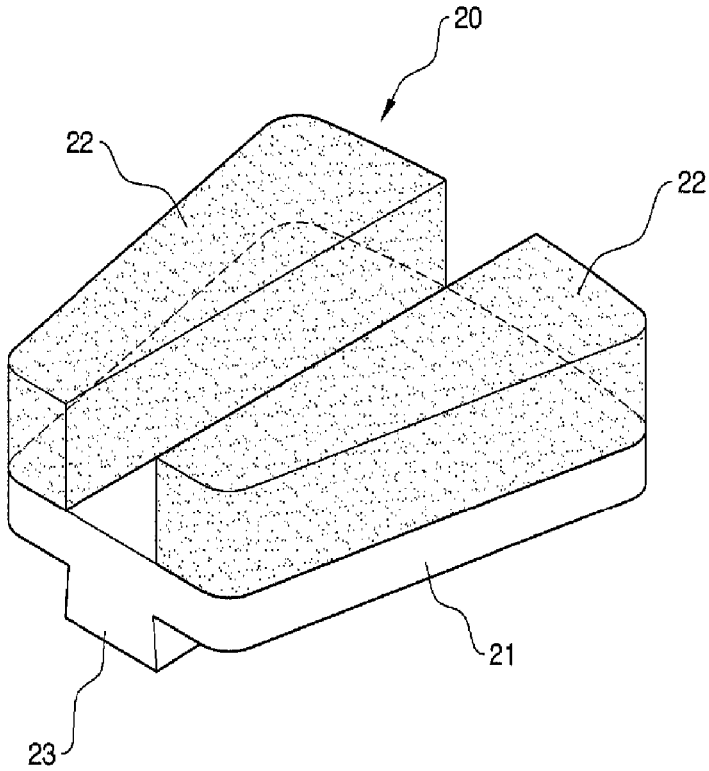
[Fig. 4]
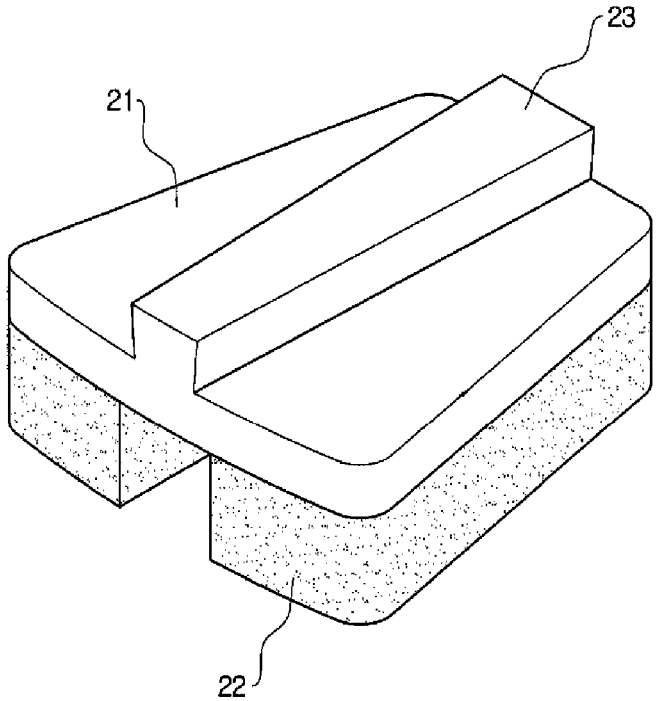

[Fig. 5]
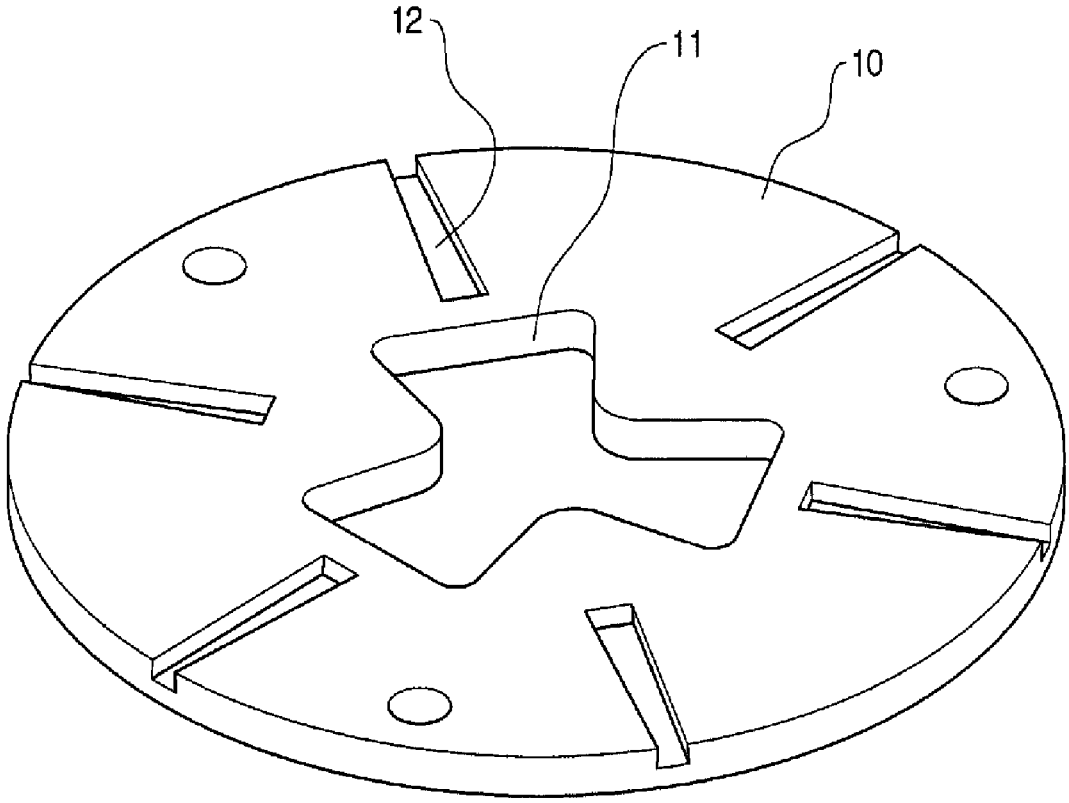

GRINDING WHEEL

TECHNICAL FIELD

The present invention relates to a grinding wheel used for grinding a surface of a rigid material such as stone, and more particularly to a grinding wheel having an abrasive segment formed by mixing, molding and sintering metal and diamond powders.

BACKGROUND ART

As shown in FIG. 1, a grinding wheel according to the prior art comprises a disc 1 and a plurality of abrasive segments 2 radially provided to a surface of the disc 1 at an interval. The grinding wheel is generally connected to a rotation axis of an electrically powered grinder (not shown) and rotated to perform an abrading operation as the grinder is driven while the abrasive segments 2 are in contact with a surface of an object to be abraded. In order to connect the wheel to the grinder, there is formed a connection hole at a center of the disc 1, to which the rotation axis of the grinder is connected.

The abrasive segment 2 is made by mixing diamond powders with metal powders such as iron (Fe), tungsten (W), cobalt (Co) and the like that are bonding agents, molding and sintering them. Then, the abrasive segments 2 are integrally attached to the surface of the disc 1 using a silver-solder welding method, for example.

Like this, according to the grinding wheel of the prior art, the abrasive segments 2 are bonded to the disc 1 with the welding method and the like. Accordingly, when it is necessary to replace the abrasive segment 2 due to wears as it is used for a long time, the whole grinding wheel 2 including the disc 1 should be replaced. In particular, even when some of the abrasive segments 2 are inferior or damaged, it is required to replace the whole grinding wheel.

DISCLOSURE OF INVENTION

Technical Problem

Accordingly, the present invention has been made to solve the above problems. An object of the invention is to provide a grinding wheel capable of detachably connecting abrasive segments to a disc in a sliding manner and individually replacing the abrasive segments.

Technical Solution

In order to achieve the above object, there is provided a grinding wheel comprising a disc having a connection hole formed at a center thereof, to which a rotation axis of an grinder is connected; and a plurality of abrasive segments detachably connected to a surface of the disc. According to the invention, a plurality of fixing recesses are radially formed on the surface of the disc at an interval and fixing protrusions having a shape corresponding to the fixing recess are formed on bottom surfaces of the abrasive segments, so that the abrasive segments are connected to the disc by inserting the fixing protrusions into the fixing recesses.

According to the invention, when the abrasive segment is worn away as the grinding wheel is used for a long time, it has only to replace the worn abrasive segment only without replacing the grinding wheel. In addition, even when something is wrong with some of the abrasive segments, it has only to replace the wrong abrasive segment only and thus an economical efficiency thereof is high.

In addition, according to the invention, the abrasive segment includes an abrasive tip mixed with diamond and metal and a metallic base part formed at a lower part of the abrasive tip. The fixing protrusion is formed a bottom surface of the base part. The abrasive tip and the base part are integrally formed by pressurizing and sintering diamond-metal mixed powders constituting the abrasive tip and metal powders constituting the base part at the same time.

Like this, since the abrasive segment is formed in a body by pressurizing and sintering diamond-metal mixed powders and metal powders, it is possible to simplify a manufacturing process of the abrasive segment and to prevent a thermal deformation which can occur during the welding operation.

In the mean time, according to an embodiment of the invention, the fixing recess and the fixing protrusion have such shape that a width thereof is gradually narrowed from a center part of the disc toward a periphery thereof so as to prevent the abrasive segment from being deviated from the disc when the grinding wheel is rotated.

Additionally, in order to prevent the deviation of the abrasive segment more positively, the fixing recess may have such shape that a bottom surface thereof is gradually inclined downwardly from the center part of the disc toward the periphery.

According to an embodiment of the invention, the fixing recess and the fixing protrusion may have a section of a dovetail shape.

BRIEF DESCRIPTION OF THE DRAWINGS

The above and other objects, features and advantages of the present invention will be more apparent from the following detailed description taken in conjunction with the accompanying drawings, in which:

FIG. 1 is a perspective view of a grinding wheel according to the prior art;

FIG. 2 is a perspective view of a grinding wheel according to an embodiment of the present invention;

FIG. 3 is a perspective view showing an abrasive segment of the grinding wheel according to the present invention;

FIG. 4 is a perspective view showing a bottom of the abrasive segment shown in FIG. 3; and FIG. 5 is a perspective view showing a disc of a grinding wheel according to an embodiment of the invention.

BEST MODE FOR CARRYING OUT THE INVENTION

Hereinafter, a preferred embodiment of the present invention will be described with reference to the accompanying drawings. In the following description of the present invention, a detailed description of known functions and configurations incorporated herein will be omitted when it may make the subject matter of the present invention rather unclear.

As shown in FIG. 2, a grinding wheel according to an embodiment of the invention comprises a disc 10 and a plurality of abrasive segments 20 radially connected to a surface of the disc 10 at an interval. A connection hole 11 is formed at a center of the disc, to which a rotation axis of a grinder (not shown) is connected.

As shown in FIG. 3, the abrasive segment 20 includes a base part 21 having a shape which is generally similar to a trapezoid and a pair of tips 22 having a shape which is approximately similar to a right-triangle, and symmetrically bonded to an upper surface of the base part 21. The tip 22 is made of a material having mixed diamond and metal and the base part 21 is made of a metal.

The abrasive segment 20 is manufactured as follows. First, there is prepared a mold (not shown) having a same shape as the abrasive segment 20. Then, a section of the mold corresponding to the base part 21 is filled with only metal powders such as iron (Fe), tungsten (W), cobalt (Co) and the like without the diamond and sections of the mold corresponding to the tips are filled with a mixture of diamond and metal powders. After that, the powders filled in the mold are pressurized and sintered, thereby resulting in a final shape of the abrasive segment 20 as shown in FIG. 3.

In order to connect the segment to the disc 10, a fixing protrusion 23 is formed at a center of a bottom surface of the base part 21 along a longitudinal direction of the base part, as shown in FIG. 4. The fixing protrusion 23 has such shape that a width thereof is gradually changed along a longitudinal direction, i.e., a trapezoidal shape.

As shown in FIG. 5, there are formed a plurality of fixing recesses 12 in the surface of the disc 10, which are radially positioned at an interval apart from each other and extended along a radial direction correspondingly to the fixing protrusions 23 of the abrasive segments 20. The fixing protrusion 23 of the abrasive segment 20 is inserted into the fixing recess 12 of the disc 10, so that the abrasive segment 20 is connected to the disc 10.

Correspondingly to the shape of the fixing protrusion 23, each of the fixing recesses 12 has a trapezoidal shape that a width thereof is gradually narrowed from the center part of the disc 10 toward a periphery thereof.

As shown in FIG. 2, the fixing protrusion 23 is inserted from a wider part of the fixing recess 12 (the center part of the disc) toward a narrow part of the recess (the periphery of the disc). When the disc 10 is rotated as the grinder is operated in performing an abrading operation, the abrasive segment 20 is forced toward the periphery of the disc 10 due to a centrifugal force. At this time, since the fixing protrusion 23 and the fixing recess 12 have the shape that the width thereof is gradually narrowed toward the periphery, the fixing protrusion 23 is moved toward the periphery along the fixing recess 12 and engaged with the recess, so that the abrasive segment 20 is tightly fixed to the disc 10.

As shown in FIGS. 4 and 5, a surface of the fixing recess 12 and a bottom surface of the fixing protrusion 23 are inclined at an angle corresponding to each other toward the periphery of the disc 10 so that the fixing protrusion 23 can be smoothly inserted into the fixing recess 12.

In addition, although it is not specifically shown in Figs., in order to positively prevent the abrasive segment 20 from being deviated from the disc when the disc 10 is turned upside down from the state shown in FIG. 5 for an abrading operation, sections of the fixing protrusion 23 and the fixing recess 12 may be formed into a dovetail shape.

INDUSTRIAL APPLICABILITY

As described above, according to the invention, the abrasive segment is detachably connected to the fixing recess of the disc surface. Accordingly, when the abrasive segment is worn away due to wears as it is used for a long time, it has only to replace the worn abrasive segment only, without the replacement of the disc. In addition, even when something is wrong with some of the abrasive segments, it has only to replace the wrong abrasive segment only and thus an economical efficiency thereof is high.

In addition, since it is not required the welding operation for shaping and connecting the abrasive segment, there is no worry that the disc is deformed due to the heat occurring during the welding operation.

While the invention has been shown and described with reference to certain preferred embodiments thereof, it will be understood by those skilled in the art that various changes in form and details may be made thereto without departing from the spirit and scope of the invention as defined by the appended claims.

The invention claimed is:

1. A grinding wheel comprising:

a disc having a connection hole formed at a center thereof, to which a rotation axis of a grinder is connected; and a plurality of abrasive segments detachably connected to a surface of the disc, wherein a plurality of fixing recesses are radially formed on the surface of the disc at an interval and fixing protrusions each having a shape corresponding to the shape of each of the fixing recesses are formed on each bottom surfaces of the abrasive segment, so that the abrasive segments are connected to the disc by inserting the fixing protrusions into the fixing recesses in a sliding manner, wherein the abrasive segments each include an abrasive tip mixed with diamond and metal and a metallic base part formed at a lower part of the abrasive tip, and the fixing protrusion is formed a bottom surface of the base part, wherein the abrasive segments each comprise an integrally formed segment of sintered abrasive and metal, wherein the fixing recesses and the fixing protrusions each have such shape that a width thereof is gradually narrowed from a center part of the disc toward a periphery, and wherein the fixing recesses each has such shape that a bottom surface thereof is gradually inclined downwardly from the center part of the disc toward a periphery.

2. The grinding wheel according to claim 1, wherein the fixing recesses and the fixing protrusions each have a section of a dovetail shape.

* * * * *